US005785436A

United States Patent [19]

Harrison et al.

[11] Patent Number: 5,785,436

[45] Date of Patent: Jul. 28, 1998

[54] DATA PLATEMARKING SYSTEM

[76] Inventors: Michael E. Harrison, 55 Mead Dr., Chillicothe, Ohio 45601; Roger L. Sieling, 367 Glenmont Ave., Columbus, Ohio 43214; Robert N. French, 172 Rosewood Ct., Chillicothe, Ohio 45601

[21] Appl. No.: 838,716

[22] Filed: Apr. 9, 1997

[51] Int. Cl.[6] ..... B41J 2/22

[52] U.S. Cl. ..... 400/124.01; 400/127; 101/3.1

[58] Field of Search ..... 400/124.01, 127, 400/128, 118.1, 118.2; 101/3.1, 4, 12, 13, 18, 19, 26

[56] References Cited

U.S. PATENT DOCUMENTS

| | | | |
|---|---|---|---|
| 4,264,219 | 4/1981 | Arai | 400/124.01 |
| 4,506,999 | 3/1985 | Robertson | 400/121 |
| 4,572,680 | 2/1986 | Kurt | 400/124.01 |
| 4,591,279 | 5/1986 | Speicher | 400/127 |
| 4,806,741 | 2/1989 | Robertson | 235/462 |
| 4,808,018 | 2/1989 | Robertson et al. | 400/121 |
| 5,015,106 | 5/1991 | Robertson et al. | 400/121 |
| 5,119,109 | 6/1992 | Robertson | 346/1.1 |
| 5,167,457 | 12/1992 | Cyphert et al. | 400/121 |
| 5,316,397 | 5/1994 | Robertson et al. | 400/121 |
| 5,368,400 | 11/1994 | Cyphert et al. | 400/124.01 |

*Primary Examiner*—Christopher A. Bennett
*Attorney, Agent, or Firm*—James R. Eley, Esq.

[57] ABSTRACT

Marking of a generally planar object at a first surface thereof with one or more indentation-defined pixels. For generating the marking, an anvil member is provided as having an impact surface. A marking head is positioned at a fixed relationship with respect to the anvil member. The head includes a confronting portion opposing the impact surface, and a marker pin having a distal impacting tip issuing from the confronting portion which is reciprocatably actuable along a marking axis from a retracted position to an extended position. With the object disposed intermediate the marking head and the anvil member, and with at least a portion of the second surface of the object being supported on the impact surface of the anvil member, the object may be positioned at a predefined pixel location within a marking locus. Thereupon, the impacting tip of the marker pin may actuated from its retracted position to its extended position impacting the second surface of the object in an indentation contact defining one of the pixel marks.

20 Claims, 7 Drawing Sheets

DATA PLATEMARKING SYSTEM

BACKGROUND OF THE INVENTION

The present invention relates broadly to marking or printing systems, and particularly to a system and apparatus therefor for marking a planar object such as a data plate or tag with a sequence of indentation-defined pixel matrix characters.

As industry has continued to refine and improve production techniques and procedures, corresponding requirements have been levied for placing identifying, data related markings upon components of manufactured assemblies. With such marking, the history of a product may be traced throughout the stages of its manufacture and components of complex machinery such as automobiles and the like may be identified, for example, in the course of investigations by governmental authorities. The call for identification, however, not only is concerned with the application of sequential, alpha-numeric strings to completed products, but also to component parts of fabrications such as automobiles and piece parts which are progressing through an industrial process, and to data plates or other tags which are attached to these parts.

A variety of product marking approaches have been employed by industry. For example, the ink and paint spraying of codes such as dot matrix codes have been employed for many manufacturing processes. Where the production environment is too rigorous, however, or subsequent painting steps are involved, such an approach has been found to be unacceptable with more permanent markings being required.

The provision of a permanent or traceable marking upon hard surfaces such as metal traditionally has been achieved with marking punches utilizing dies which carry a collection of fully formed characters. These "full face dies" may be positioned in a wheel or ball form of die carrier which is manipulated to define a necessarily short message as it is dynamically struck into the material to be marked. As is apparent, the necessarily complex mechanisms involved are prone to failure and full face dies exhibit rapid wear. Generally, the legibility and abrasion resistance of the resultant marks can be considered to be only fair in quality. Additionally, the marking punch approach is considered a poor performer in marking such surfaces as epoxy coatings and the like.

Laser activated marking systems also have been employed. However, such systems are of relatively higher cost and the abrasion resistance and "readability after painting" characteristics of laser formed characters are considered somewhat poor.

A technique that has been successful in the marketplace for generating permanent markings upon the surfaces of somewhat malleable materials such as metals and plastics is described by Robertson in commonly-assigned U.S. Pat. No. 4,506,999 entitled "Program Controlled Pin Matrix Embossing Apparatus." Such technique involves a computer controlled dot matrix marking device utilizing an array of pneumatically-driven tool steel punches to generate human and/or machine readable dot characters or codes. Marketed commercially under the trade designation "PINSTAMP®," these devices carry the noted steel pins in a head assembly which is moved relative to the workpiece being marked at selected skew angles to indent a dot or pixel defining permanent message or code into a surface. The system enjoys the advantage of providing characters of good legibility as well as permanence. Additionally, a capability for forming the messages or codes during forward or reverse head movements is realized.

Robertson el aL, in commonly-assigned U.S. Pat. No. 4,808,018, entitled "Marking Apparatus with Matrix Defining Locus of Movement", issued Feb. 28, 1989, describe a dot matrix character impact marking apparatus which is capable of forming messages or arrays of characters within a very confined region. With this device, a linear array of marker pins is moved by a carriage in a manner defining an undulating locus of movement. This locus traces the matrix within which character fonts are formed by the marker pins. The carriage and head containing the marker pins are pivotally driven by a cam to provide vertical movement and by a Geneva mechanism to provide horizontal movement. Pixel positions for the matrices are physically established in concert with pin or carriage locations by a timing disk and control over the pins is generated in conjunction with an interrupt/processor approach. Each marking pin of the pin array within the head assembly of this portable device is capable of marking more than one complete character for a given traverse of the head between its limits of moment.

Robertson et aL, in U.S. Pat. No. 5,015,106, issued May 14, 1991, and entitled "Marking Apparatus with Multiple Line Capability" describe a dot matrix character impact marking apparatus which achieves a multiple line capability wherein a carriage component carrying one or more marker pin cartridges moves within a singular plane locus of movement. This multiple line capability advantageously has permitted a broad variety of line configurations, for example in widely spaced positions at a workpiece. The device further employs a retrace method in generating a locus of marking movement somewhat similar to the formation of a raster in conjunction with television systems. A modular approach for the device is provided utilizing a forward housing carrying the locus defining component of the device which is then actuated from a rearwardly disposed motor containing housing component which served to drive cam assemblies at the forward portion. The carriage component of the device carries a manifold which, in turn, carries one or more marker pin cartridges, the pins of which are driven from an externally disposed valved and pressurized air supply. As before, the device performs in conjunction with a predetermined character defining matrix of pixel positions, each position of the matrix being identified to the system by a timing disk physically maneuvered with the drive components.

Robertson et al., in commonly-assigned U.S. Pat. No. 5,316,397, entitled "Marking Apparatus With Multiple Marking Modes", filed Jul. 31, 1992, describe a matrix form of character marking utilizing a single plane undulatory motion of the pin cartridge carrying carriage, as well as a capability for the above-described raster form of locus of movement. This flexibility is achieved through the utilization of software changes as opposed to the insertion of hardware-based timing components and the like. The system disclosed exhibits a capability for full form character formation. This requires the actuation of the marker pins in a manner wherein discrete dots or pixels are not observable, the indentations formed by these pins being so closely nested as to evoke the image of a continuous line forming each character. Cyphert et aL, in commonly-assigned U.S. Pat. No. 5,368,400, entitled "Marking Apparatus With Drive Cable" describe another dot matrix impact marking apparatus which is of a relatively light construction having the capability of accurately and rapidly positioning a marker head at coordinate defined locations within a marking field. Utilizing two, fixed stepper motor drives, the marker head is positioned by a very light system of cables and pulleys, the cables being positively driven by a capturing capstan configuration at the outputs of the two motors. Accommodation of the relatively light apparatus to the rigorous dynamics associated with the impacting and rebounding of a pneumatically driven steel marker pin system is achieved through the utilization of a stiff air bearing support of a lightweight marker base. In this regard, the marker base, which preferably is formed of plastic, is supported in force transfer relationship over the air bearing which, in turn, rides over a flat platen support surface.

Cyphert et al., in commonly-assigned U.S. Pat. No. 5,167,457, entitled "Apparatus and Method for Marking Arcuately Configured Character Strings" describe a dot matrix impact marking system which is adapted to the formation of character strings in arcuate fashion. Another such system adapted for marking the curved inner surface of pipes is described again by Robertson in commonly-assigned U.S. Pat. No. 5,119,109, entitled "Method and Apparatus for Marking the Inside Surface of Pipes."

The reading of dot matrix characters and codes following their formation may be carried out by a video based system described in U.S. Pat. No. 4,806,741, by Robertson, entitled "Electronic Code Enhancement for Code Readers", issued Feb. 21, 1989, and assigned in common herewith.

Certain marking applications of the floating pin impact concept call for the use of a single marking pin as opposed to an array of pins. Guidance of this form of single pin typically has been carried out under robotic control. One such system currently is marketed under the trade designation "TMP 6000" by Telesis Technologies, Inc., of Circleville, Ohio, the original assignee of the present application.

As the above-described capabilities for the permanent impact marking of metals and plastics have been introduced and enhanced, industry has continued to call for the extension thereof to other applications. For example, in the manufacture of valves and other fluid power or motion control components, there exists a need to mark tags, labels, and other such thin, Generally planar "data plates" therefor with serialized, alphanumeric character strings for inventory control and tracking, as well as with other information such as product designations and operating characteristics. The marking of these data plates heretofore has eluded the application of impact marking techniques. The industry, rather, has persisted in using more conventional ink printing or die punching notwithstanding the drawbacks of these methods. Thus there has existed and remains a need for a impact marking system capable of generating the preferred indentation-defined pixel matrix characters on the surface of data plates and other objects of like configuration.

BROAD STATEMENT OF THE INVENTION

The present invention is directed to an impact pin-based marking system particularly adapted to the permanent marking of planar objects, such as data plates and tags, with indentation-defined matrix characters. In utilizing a stationary, single-pin marking head and an anvil spaced-apart therefrom for supporting the object, the system of the invention is able to control flexure and otherwise accommodate the difficult marking geometry of these objects. When used in conjunction with a feeding mechanism which individually dispenses the objects from a stack thereof, and a gripping mechanism which is controllable to position each object at one or more predefined pixels for marking between the head and anvil, the system may be operated in an automated fashion.

A feature of the preferred embodiment of the present invention therefore is to provide a system for marking a generally planar object at a first surface thereof with one or more indentation-defined pixels. The system employs an apparatus that includes an anvil member having an impact surface fixably mounted at a predetermined position within a coordinate plane defined by the intersection of an orthogonal pair of coordinate axes. The impact surface is configured for supporting at least a portion of the second surface of the object when the object is moved into a bearing adjacency therewith. The apparatus also includes a marking head which is positionable in a fixed relationship with respect to the anvil member. The marking head includes a confronting portion which opposes the impact surface of the anvil member at a space-apart distance therefrom, and a marker pin having a distal impacting tip which is issuable from the confronting surface. The impacting tip is reciprocatably movable along a marking axis disposed generally perpendicular to the coordinate plane from a retracted position spaced-apart from the plane to an extended position within the plane defining a stroke length of the pin. For moving the object into bearing adjacency with the anvil, a gripper is provided as being actuable in a first position to grip the object along an edge thereof, and being movable with the object along the first coordinate axis to a second position disposing the object intermediate the marking head assembly and the anvil member. At the second position, the gripper is provided to be further movable with the object along the coordinate axes to define a marking locus between the edges of the object wherein the first surface of the object is disposed at one or more predefined pixel locations for indentation contact with the impact tip when the tip is moved to its extended position.

Another feature of the preferred embodiment of the present invention is to provide a method for marking a generally planar object at a first surface thereof with one or more indentation-defined pixels. For generating the marking, an anvil member is provided as having an impact surface. A marking head is positioned at a fixed relationship with respect to the anvil member. The head includes a confronting portion opposing the impact surface, and a marker pin having a distal impacting tip issuing from the confronting portion which is reciprocatably actuable along a marking axis from a retracted position plane to an extended position. With the object disposed intermediate the marking head and the anvil member, and with at least a portion of the second surface of the object being supported on the impact surface of the anvil member, the object may be positioned at a predefined pixel location within a marking locus. Thereupon, the impacting tip of the marker pin may actuated from its retracted position to its extended position impacting the first surface of the object in an indentation contact defining one of the pixel marks.

Advantages of the present invention include a marking system for the permanent marking of a variety materials such as steel, aluminum, and plastics, and an apparatus therefor which accommodates the marking of generally planar objects such as data plates and tags. Such apparatus may include an automated gripping and feeding arrangement controllable to individually extract objects from a stack for presentation to a stationary marking head. Advantageously, the movement of each object from the stack to the marking head, as well as the positioning of the object relative to the head at select pixel locations within a marking locus, may be effected within a single plane for ease of control. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
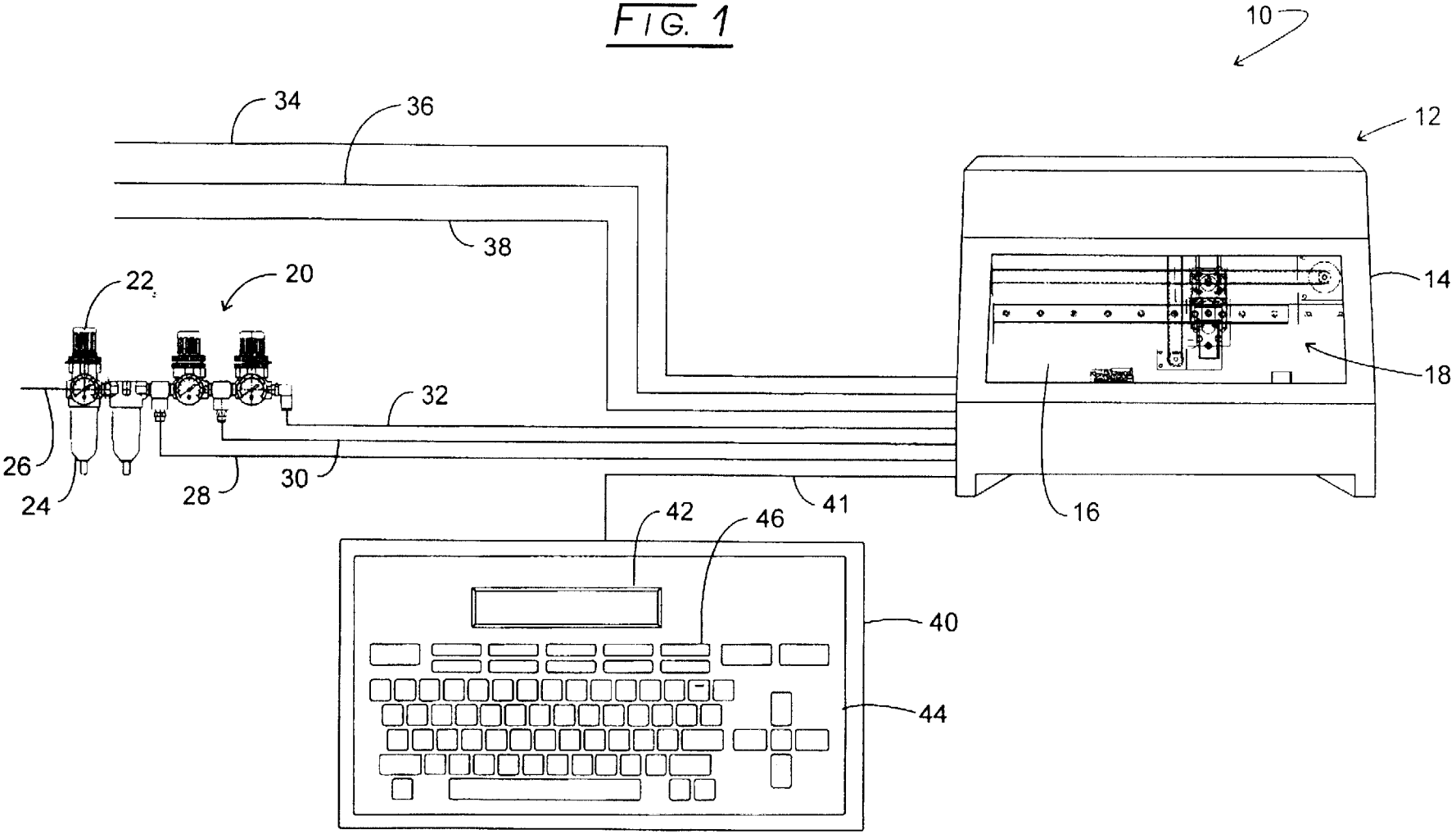
FIG. 1 is a plan view of the marking apparatus of the present invention shown to include a protective housing and cover, and as in operative association with pneumatic and control inputs therefor.

The drawings will be described further in connection with the following Detailed Description of the Invention.

DETAILED DESCRIPTION OF THE INVENTION

Certain terminology may be employed in the description to follow for convenience rather than for any limiting purpose. For example, the terms "forward," "rearward," "right," "left," "upper," and "lower" designate directions in the drawings to which reference is made, with the terms "inward" and "outward" referring, respectively, to directions toward and away from the center of the referenced element. Terminology of similar import other than the words specifically mentioned above likewise is to be considered as being used for purposes of convenience rather than in any limiting sense.

For the purposes of the discourse to follow, the precepts of the marking system of the invention herein involved are described in connection with its utilization in connection with the permanent indentation-defined pixel marking of a data plate or tag which may be attached, for example, to a valve or other motion control component for its identification. It will be appreciated, however, that aspects of the present invention will find utility in connection with the marking of other such generally planar objects. The following description therefor should be construed as illustrative rather than limiting.

Referring to FIG. 1, the a plan view of a marking system in accordance with the present invention is revealed generally at 10 as including a marking apparatus or printer, 12, which is shown in a somewhat stylized fashion to be operably coupled with associated with pneumatic, control, and other inputs. Printer 12, which will be noted to be of a compact configuration having a relatively small "footprint," includes a protective housing or other enclosure, 14, having a windowed door 16, for operator access and monitoring during the printing cycle. Within enclosure 14 are received the pneumatic and electromechanical control components, represented generally at 18, of the apparatus.

For the operation of the noted pneumatic components of printer 12, a source of air pressure is supplied via a regulator unit, shown generally at 20, which may include one or more flow control valves, one of which is referenced at 22, and associated filters, one of which is referenced at 24. In the arrangement shown, facility air pressure is supplied to unit 20 via input line 26, with regulated outputs to printer 12 being supplied via lines 28, 30, and 32. Similarly, electrical power for energization of the electromechanical system components may be provided via line 34. Optionally, one or more external connections may be provided via lines 36 and 38 for remote I/O signaling and other serial or parallel host interfacing communication. Lastly in connection with FIG. 1, a controller, represented at 40, may be provided for deriving control inputs supplied to apparatus 12 via line 41. Preferably, controller 40 includes an alphanumeric display, 42, which may be of either a liquid crystal (LCD) or a light emitting diode (LED) type. Readouts from display 42 may provide visible cues as operator prompts for the inputting of operational control parameters such as, for example, character fields, and also messages such as alerts to the operational status of the printer. Controller 40 may also include a manually-actuable keyboard, 44, having one or more predefined function keys, one of which is referenced at 46, for the direct operator selection of preprogrammed printing modes and other functions. As is conventional, controller 40 may operate under a microprocessor-based control which utilizes, for example, an integrated RAM for digital data storage and an EPROM for storage of firmware having microencoded data acquisition routines and computational algorithms.

Figure 2:
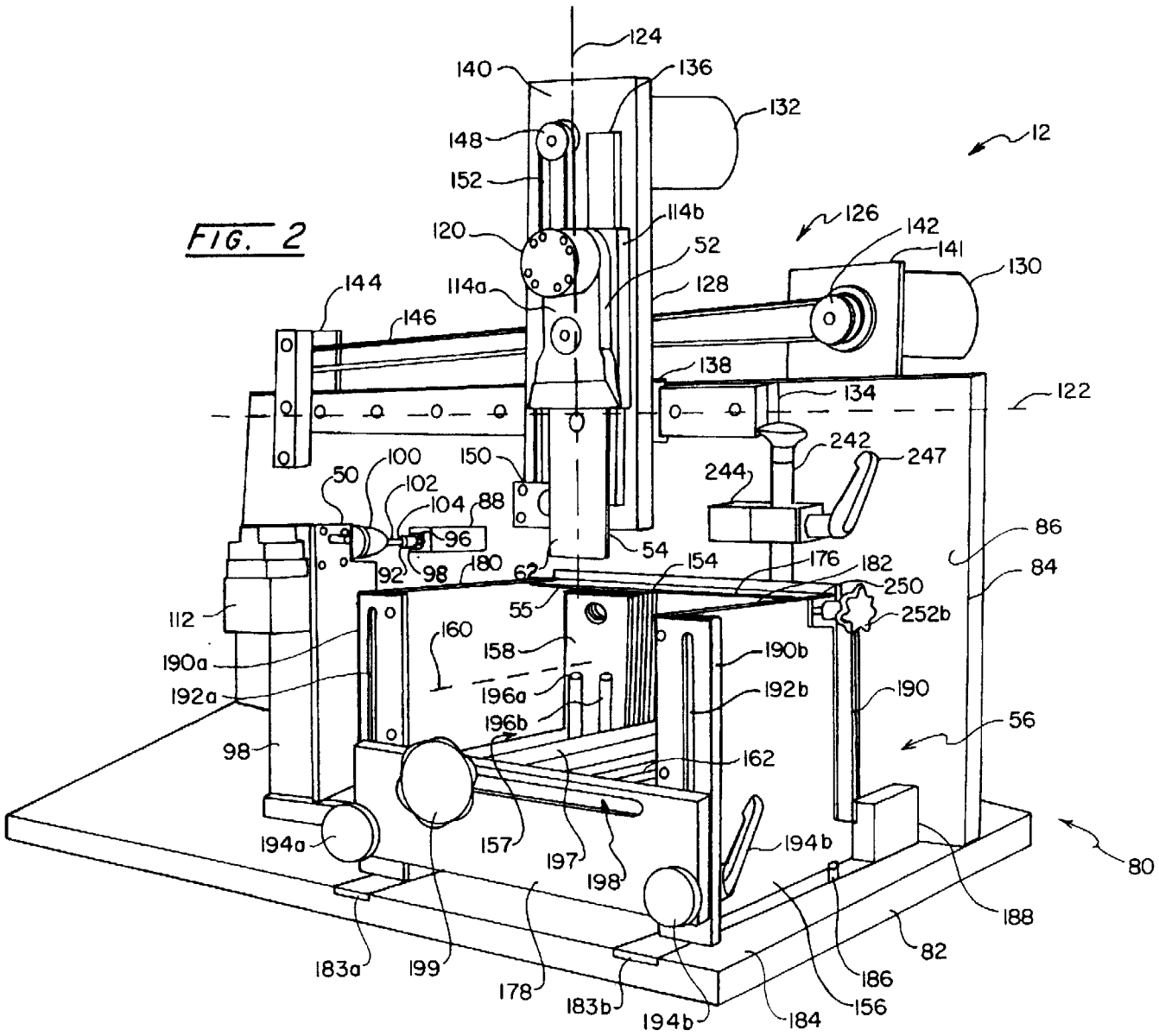
FIG. 2 is a perspective view of the apparatus of FIG. 1 including a gripper and associated magazine and feed assembly, which magazine is loaded with a stack of data plates or like objects for the marking thereof.

Turning to FIG. 2, the details of printer 12 next may be considered through reference to the perspective view shown. In basic construction, printer 12 includes an anvil, 48, a marking head assembly, 50, positionable at a fixed relationship with respect to anvil 48, and a clamping-type gripper, 52. Gripper 52 is actuable to extract a workpiece or other object, exemplified by the data plate shown at 54, from a stacked plurality thereof, 55, which is received within a feed assembly, referenced generally at 56. Depending upon the thickness of plates 54, stack 55 typically may contain from about 70 to 250 plates. As will be detailed hereinafter, gripper 52 is movable to dispose data plate 54 intermediate anvil 48 and marking head assembly 50, with the plate second surface being bearingly supported in a force transferring engagement on anvil 48 for the permanent marking of the object with one or more sequences of indentation-defined pixel matrix characters conveying user-defined information. Looking momentarily to FIG. 3 wherein a data plate 54 is shown in enhanced detailed, one such character is referenced at 58 as embodied within a marking field, 60, on a first or upper surface, 62, of the plate. It is highly desirable, of course, that these characters 58 be formed with uniform, dot-like indentations or pixels to promote easier visual reading. Where these characters are formed, for example, as machine-readable optical codes, then the quality of this dot marking is quite important in assuring reliable character recognition. While a dot matrix character configuration is shown for exemplary purposes, printer 12 additionally may be operable in a "continuous" mode wherein the individual dot indentations are not discretely visible, but rather are overlapped to be perceived as continuous line formations by the viewer. In either mode, characters 58 may range in size, for example, from about 0.03–2.00 in (0.76–250.8 mm), and may be spaced at increments as small as about 0.001 in (0.025 mm). The character string also may be rotated to be printed at an angle on plate 54.

Figure 3:
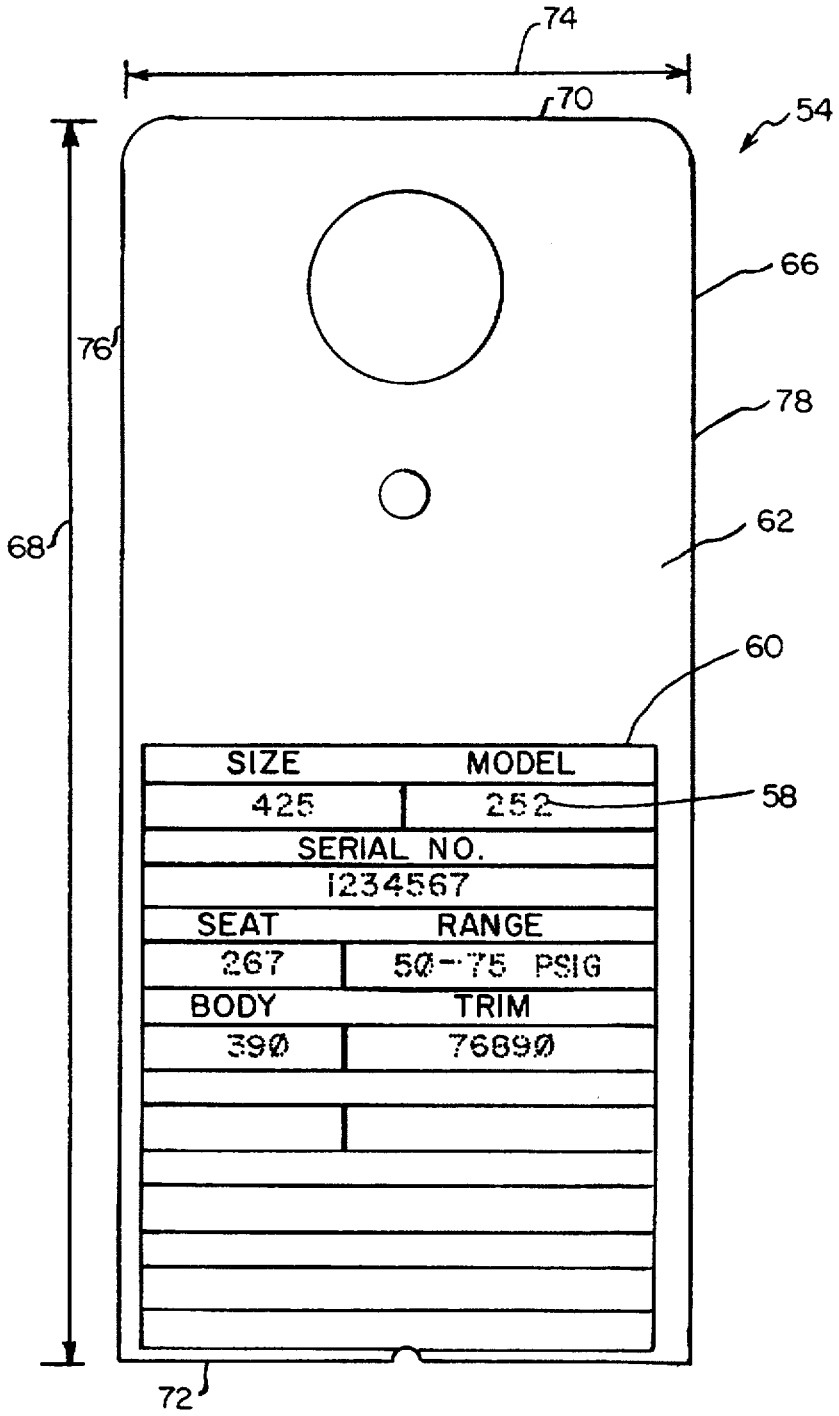
FIG. 3 is a front view of a representative data plate shown as marked with a sequence of indentation defined pixel matrix character using the system of the present invention.
Figure 4:
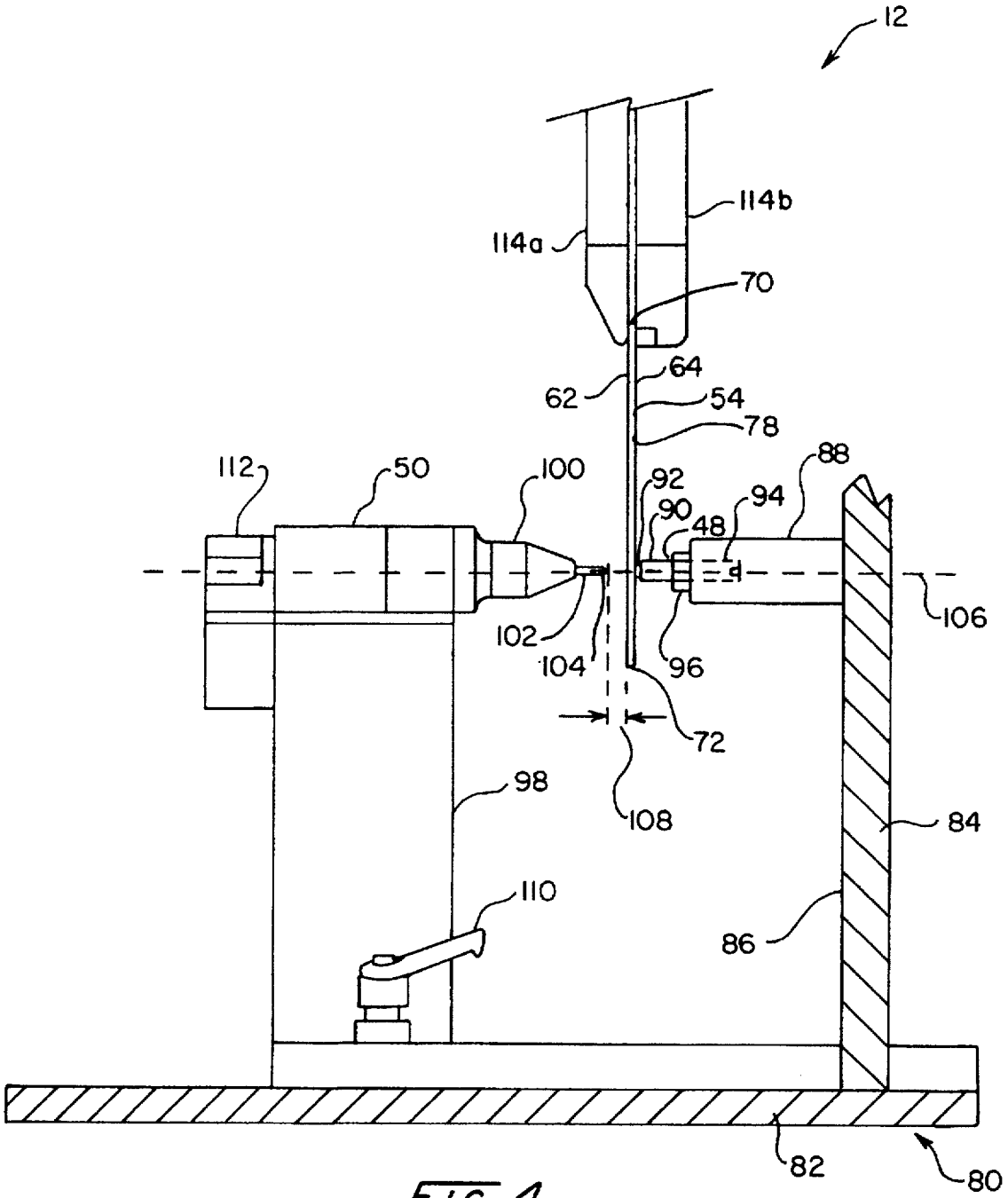
FIG. 4 is side, sectional view of the apparatus of FIG. 2 which has been simplified to illustrate the marking mode operation thereof wherein the extracted data plate is positioned by the gripper intermediate the marking head and anvil member.

Although hidden from view in FIG. 3, plate 54 additionally includes an opposing second or lower surface which may be seen at 64 in FIG. 4. The peripheries of surfaces 62 and 64 of plate 54 define an outer margin thereof, 66, which extends along a lengthwise dimension, referenced at 68, intermediate an upper end edge, 70, and a lower end edge, 72. Margin 66 continues as extending along a widthwise dimension, referenced at 74, intermediate a first side edge, 76, and a second side edge, 78. As defined by dimensions 68 and 74, plate 54 may range in size from about 0.75 in by 0.75 in (19 mm by 19 mm) to about 5 in by 4 in (127 mm by 101 mm). Plate 54 may be formed of any indentable or embossable material, but most often will be of a steel, aluminum, brass or plastic construction having a thickness of from about 0.020–0.070 in (0.51–1.78 mm). An overlay (not shown) of a transparent polymeric film conventionally may be provided to protect the finish of first surface 62 of plate 54 from scratches or abrasions during shipping and handling. Advantageously, the permanent indentation marking of the plate may be effected in accordance with the present invention through such overlay.

Returning to FIG. 2, printer 12 additionally incorporates a support frame, shown at 80, including a base plate 82 and a rearward, upright backplate 84, extending upwardly therefrom. Looking additionally to FIG. 4, anvil 48 may be seen to be fixably attached to a rearwardly-facing surface 86, of backplate 84 via a mount 88. Preferably, anvil 48 is provided as a generally cylindrical member which extends from a distal rearward portion 90, including an impact surface 92, configured for supporting at least a portion of the second surface 64 of data plate 54, to a proximal forward portion 94, threadably engaged with mount 88 and locked therein with an associated nut 96. In this way, the distal extension from mount 88 of anvil rearward portion 90, and impact surface 92 thereof, may be adjusted. In applications wherein it is desired to emboss the data plate 54, i.e., to have the marked characters raised from the surface of the plate, the durometer value of the material comprising the anvil impact surface 92 may be selected which would permit the marking pin 102 to more fully penetrate the body of plate 54 into the surface of the anvil. In this manner the marked characters would be raised from the second, in this case rear, surface 64 of the plate 54. Of course, in order to achieve such marking of the second surface of the plate 54 would most likely encompass loading the plates in the feed assembly 56 in a reverse order, that is, any preprinting would face the anvil and away from the marking pin. Additionally, in order to have the characters right-reading from the rear of plate 54 would require that the marking algorithm in the central processing unit (CPU) for the characters be reversed.

As also may be seen best in FIG. 4, marking head 50 is supported a spaced-apart distance opposite anvil 48 on a upright stanchion mount 98, which, in turn, is slidably movably supported on base 82. Marking head 50 includes a forward confronting portion 100, opposing impact surface 92 of anvil 48, and a marker pin 102, issuing from confronting portion 100. Such marker pins are described in greater detail in U.S. Pat. Nos. 4,506,999 and 4,9808,018, but generally are provided as having a diameter of from about 0.093–0.375 in (2.36–9.53 mm), and as having a distal, generally frustro-conical impacting tip, such as tip 104 of pin 102. Preferably, pin 102 is formed of a hardened tool steel of powder-metal material, and may be solid tungsten carbide or carbide tipped. Impacting tip 104, which may define a cone angle of from about 20°–60°, is pneumatically reciprocable along marking axis 106 from the retracted position shown in FIG. 4, to an extended position within the plane of the first surface 62 of workpiece 54 defining a stroke length 108, of pin 102 which typically will be from about 0.25–0.50 in (6.4–12.7 mm). At its extended position, impacting tip 104 thereby is provided to achieve an indentation contact, typically at a depth of 0.012 in (0.25 mm) or less, with workpiece surface 62 defining a pixel mark. A locking lever 110, may be used for the adjustable positioning of pin mount 98 on base 82. In this way, marking head 50 thereby is made to be positionable along axis 106 at a variably fixed standoff relationship relative to anvil impacting surface 92 and workpiece surface 62 for adjusting stroke length 108 to accommodate for the thickness of workpiece.

In a manner which is described more particularly in U.S. Pat. Nos. 4,506,999; 4,808,018; 5,015,106; 5,316,397; and 5,368,400, in the above-cited references, pin tip 104 is maintained in and returned to its retracted position by a constant supply of return air pressure, preferably between about 10–30 psi (0.7–2.0 bars), provided to head 50 by line 32 shown in FIG. 1. Drive air similarly is provided to head 50, preferably at a pressure between about 60–120 psi (4.1–8.2 bars), by line 30, but as a pulsed pneumatic input under the control of solenoid-actuated valve or the like, such as valve 112. The term "air" as used herein is intended to encompass gaseous fluids other than air which are likewise suited to the purpose at hand.

Figure 5:
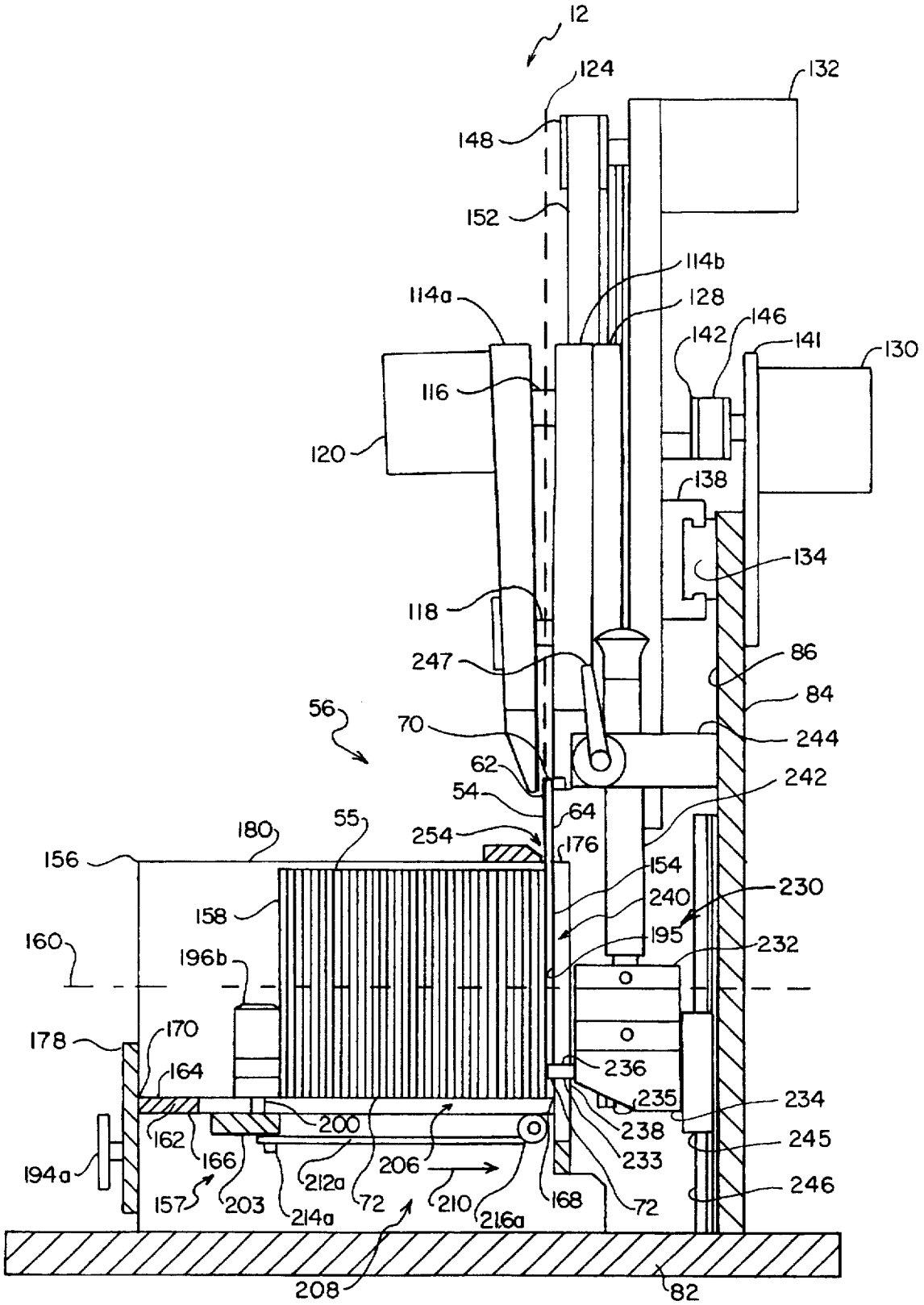
FIG. 5 is another side, cross-sectional view of the apparatus of FIG. 2 illustrating the extraction mode operation thereof in displacing a single data plate from a forward end of the stack.

Returning to FIG. 2, and looking additionally to FIG. 5, gripper 52 may be seen to be actuable in a first position, shown in FIG. 5, to grip a data plate 54 along upper edge 70 for the extraction of the plate from stack 55, and to be movable with plate 54 to a second position, shown in FIG. 4, disposing plate 54 intermediate marking pin impacting tip 104 and anvil impacting surface 92. Generally, it is preferred to minimize the grip area of gripper 52 along the upper edge 70 of plate 54 to about 0.125 in (3 mm) or less for increasing the available marking window of the plate. For gripping plate 54, gripper 52 is provided as including a pair of articulable jaws, **114*a* and 114*b*, respectively, which are coupled at 116 and 118, to be actuable between a closed orientation, shown in FIG. 5, for gripping the plate, and an opened orientation for releasing the plate. In the arrangement shown, jaw 114*b* is provided to be fixed, with jaw 114*a* being provided to be movably clampable with respect thereto. Clamping pressure may be provided by an associated cylinder, 120, or other pneumatic or electromechanical means operably coupled to movable jaw 114*a*. The plate contacting portion of either or both of gripper jaws 114*a* and 14*b* may be fitted or otherwise coated with a surface, such as a spray metalization coating, for increasing the friction and thus the gripping facility between the plate 54 and the gripper 52**.

For simplified operation, the movement of gripper 52 between its first and second positions may be controlled in only two degrees of freedom corresponding to an x-y coordinate sense. Accordingly, in the preferred embodiment shown, gripper 52 is adapted to be movable along a first, generally horizontal coordinate axis, represented by line 122, and along a second, generally vertical coordinate axis, represented by line 124, which is disposed orthogonal to first coordinate axis 122. It will be appreciated that the intersection of axes 122 and 124 defines a coordinate plane within which the motion and marking of each of data plates 54 advantageously may be effected. That is, in providing for the delivery, movement and marking of each of the data plates within the plane defined by axes 122 and 124, the requirement to provide for a third degree of control is obviated.

For effecting this mono-planar movement of gripper 52, printer 12 additionally is provided as having a drive assembly, shown generally at 126, including a generally planar carriage, 128, first and second drive motors, 130 and 132, and first and second rail members, 134 and 136. As is shown in FIG. 2, first rail member 134 may be bolted or otherwise fixably mounted on the rearward surface 86 of backplate 84 as extending generally along horizontal axis 122. For translation along rail 134, carriage 128 is slidably movably supported thereon via a forwardly-facing bearing, 138, interposed therebetween. Second rail member 136, in turn, is bolted or otherwise fixably mounted on the rearwardly-facing surface, 140, of carriage 128 as extending generally along vertical axis 124. Similarly to carriage 128, gripper 52 is slidably movably supported on rail 136 for translation along vertical axis 124.

The motive force for powering the translation of carriage 128 and gripper along rails 134 and 136 is supplied by motors 130 and 132, which preferably are of a stepper-variety having rotational outputs. In this regard, motor 134, which is mounted on an associated support plate, 141, to backplate 84, is operably coupled to carriage 128 via a pair of associated drive and idler pulleys, the drive one of which is shown at 142 as rotationally drivably coupled to the rotational shaft output of motor 130, and the idler other one of which is supported at 144 as spaced-apart from pulley 142 along horizontal axis 122. Pulleys 142 and 144 are coupled by a continuous "toothed," timing-type drive belt, 146, which in turn is enmeshed with carriage 128 to effect the translation thereof along rail 134. Motor 132, which is mounted on carriage 128, likewise is operably coupled to gripper 52 via associated drive and idler pulleys 148 and 150, and belt 152. With drive pulley 148 being rotationally drivably coupled to the rotational shaft output of motor 132 and idler pulley 150 being spaced-apart along vertical axis 124, belt 152 thereby may be enmeshed with gripper jaw **114*b* to effect the translation thereof along rail 136**.

Control input signals may be provided to motors 130 and 132 via controller 40 (FIG. 1) in conventional fashion for the accurate positioning of gripper 52 along axes 122 and 124. Advantageously, this positioning may be effected in discrete translational increments both for accuracy of control, and for facilitating the coordination of the movement of gripper 52 and data plate 54 with the actuation of marking pin 102. That is, within its second position, gripper 52 may be moved along axes 122 and 124 in series of translational increments for the positioning of data plate 52 within a marking locus thereof at a sequence of predetermined pixel marking locations. Pin 102 may be provided to be actuable intermediate these increments to effect the marking of the plate without otherwise having to accommodate for the plate movement. However, although the described motor, pulley, and belt arrangement is for that reason preferred, it will be appreciated that other motion arrangements employing, for example, ball screws, wire ropes or cables, linear or rotary actuators, or the like alternatively may be employed and therefore expressly are to be considered within the precepts of the present invention herein involved.

Figure 7:
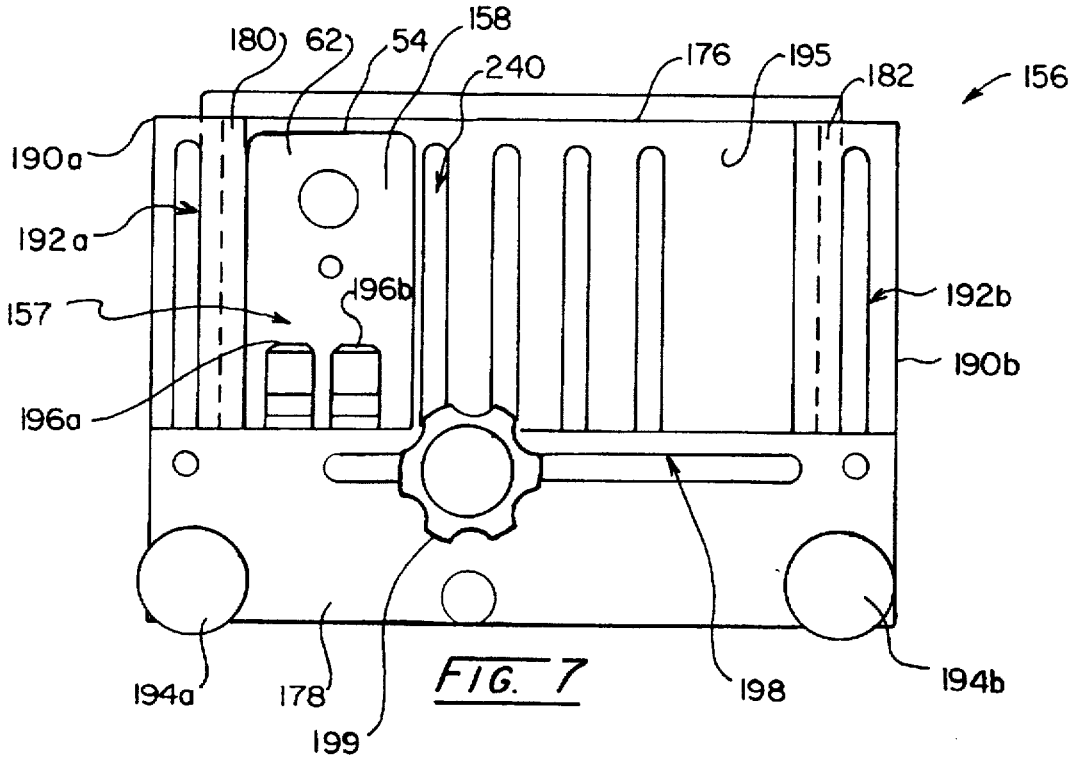
FIG. 7 is a rearward end view of the magazine and feed assembly FIG. 6.
Figure 8:
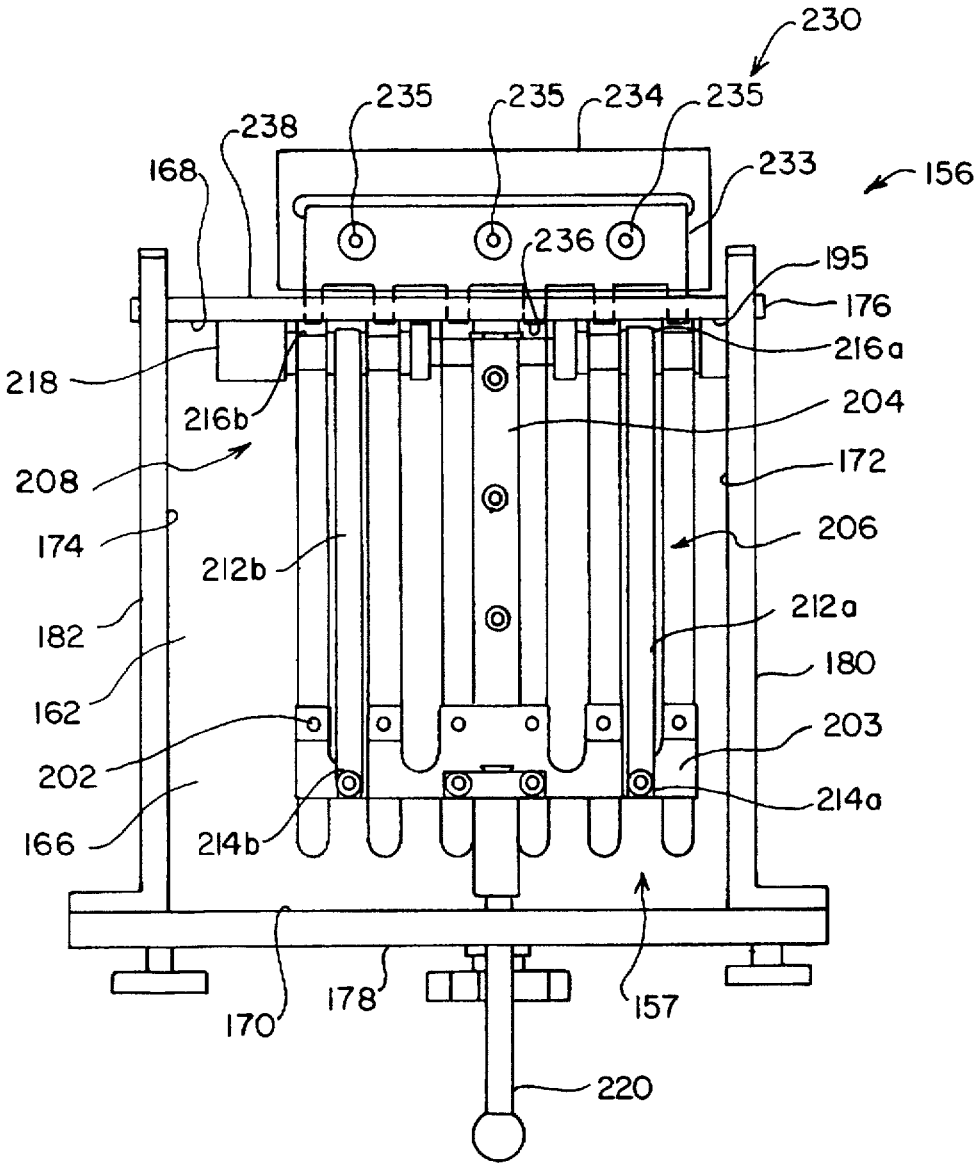
FIG. 8 is a bottom view of the magazine and feed assembly FIG. 6.

Considering next feed assembly 56, such assembly is adapted as shown in FIG. 2 to sequentially present a plate 54 from the forward end, 154, of stack 55, in a generally upstanding relationship as aligned co-planarly with the coordinate plane defined by axes 122 and 124. In this regard, feed assembly 56 includes a magazine, 156, configured for receiving plate stack 55 in compression, and an associated assemblage, designated generally at 157, for successively advancing each next succeeding one of plates 54 into grippable adjacency with gripper 52 at the forward end 154 of stack 55 as the immediately preceding plate 54 is displaced therefrom. As received within magazine 156, stack 55 extends from forward end 154 to a rearward end, 158, as aligned with a feed axis, 160, disposed generally perpendicularly to the coordinate plane defined by axes 122 and 124. Looking additionally to FIGS. 6, 7, and 8 wherein top, end, and bottom views of magazine 156 are respectively shown, magazine 156 may be seen to include a floor, 162, which has an upper surface 164, for supporting the lower edges 72 of plates 54, and a lower surface, 166. Floor 162 further may be seen in FIGS. 6 and 8 to extend along axis 160 from a forward end, 168, to a rearward end, 170, and along axis 122 from a left side, 172, to a right side, 174. Floor 162 is partially enclosed to define a generally polygonal area by upstanding walls 176, 178, 180, and 182, which walls are disposed in bounding adjacency with, respectively, the forward and rearward ends, and the left and right sides of the floor.

Magazine 156 is received on base 82 of frame 80 as aligned vertically under gripper 52 when the gripper is disposed at its first position in grippable adjacency with the forward end 154 of stack 55. To facilitate the alignment of magazine 156 on base 82, a pair of elongate bearing surfaces, **183*a* and 183*b*, preferably are incorporated within base 82 as extending longitudinally along feed axis 160. Bearing surfaces 183, which are spaced-apart on the upper surface 184 of base 82 to receive magazine side walls 180 and 182 thereon, may be formed of a polymeric material having a relatively low coefficient of friction. Magazine 156 thereby may be slidably positioned on base upper surface 184, as assisted by one or more alignment pins, 186. For providing a positive stop for the positioning of magazine 156, one or more forward lugs, 188, may be attached to base surface 184 to be abuttingly engaged by an outwardly extending flange, 190, of wall 182. In production, two or more magazines 156** may be provided to facilitate the off-line loading thereof with workpieces.

In order to accommodate for differing lengthwise extents 68 (FIG. 3) of the workpieces, it is preferred that floor 162 is vertically movably supported intermediate side walls 180 and 182. In this regard, sidewalls 180 and 182 each may be provided as having an outwardly-extending flange, **190*a* and 190*b*, respectively, at the rearward ends thereof As is shown in FIG. 2, each of flanges 190 is configured as having an elongate, longitudinally-extending slot, 192*a* and 192*b*, along which floor 162 and attached rearward wall 178 are slidably positionably supported. An associated pair of spring-loaded levers, 194*a* and 194*b*, may be operably coupled through slots 192 to floor 162 and wall 178 for releasably securing floor 162 at select vertical positionings relative to gripper 52 along axis 124. With floor 162 being thereby positionable, the upper edge 70 of each plate 54 displaced from the forward end 154 of stack 55 is disposable at a predetermined vertical distance from gripper 52** when the gripper is disposed at its first position in grippable adjacency therewith.

Looking next to FIG. 5, and returning to FIGS. 6–8, stack 55 may be seen to be received in a generally linear alignment along feed axis 160 between the rearwardly-facing surface, 195, of magazine forward wall 176, and one or more upright stanchion members, two of which are referenced at **196*a–b***.

Figure 6:
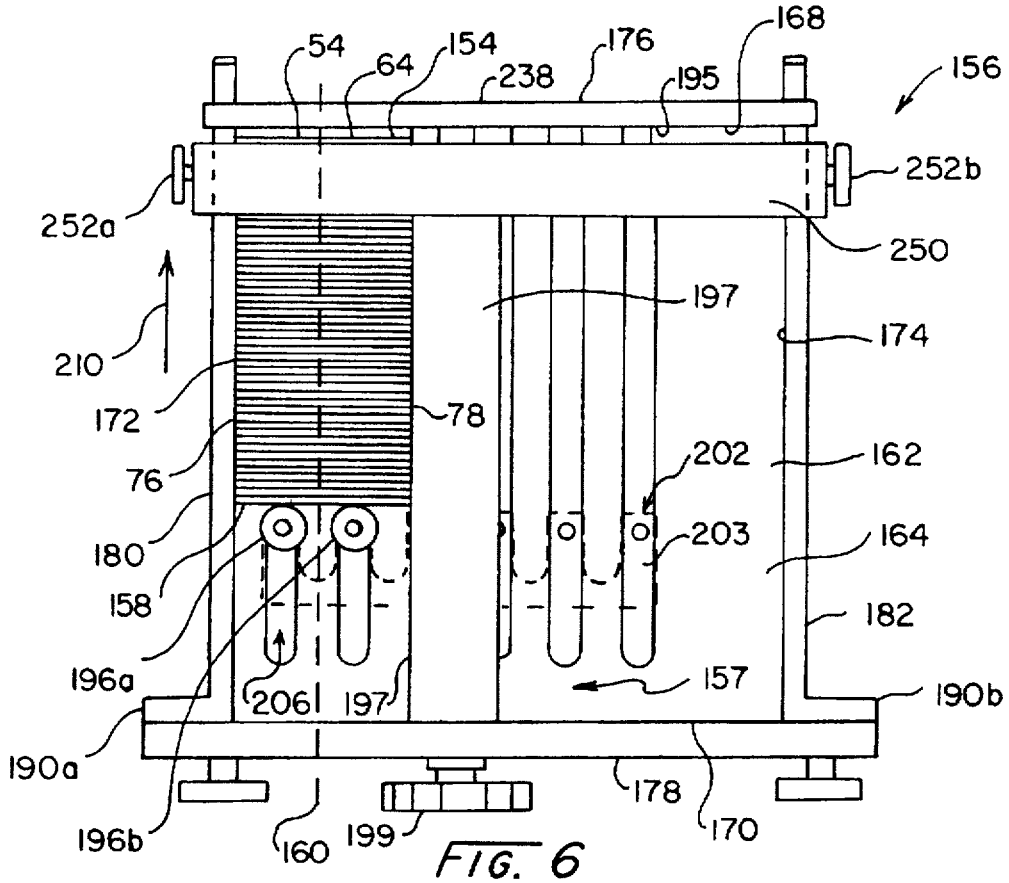
FIG. 6 is a top view of the magazine and feed assembly of the apparatus of FIG. 2.

For effecting this alignment, a fence member, 197, which may be seen best through momentary reference to FIGS. 2, 5, and 6, optionally may be employed as disposable in a shoe-type arrangement between the second edges 78 of stack plates 54, and the right side wall 182. As slidably adjustably received within a groove, 198, formed within rearward wall 178, fence member 197 thereby is provided to extend along floor 162 generally parallel to feed axis 160 intermediate the magazine forward and rearward end walls 176 and 178. Within groove 198, fence member 197 is lockably positionable with an associated adjustment knob, 199, at a spaced-apart distance from the inward surface of left side wall 180 in a manner justifying the edges 76 and 78 of stack 55 therebetween.

Returning to FIG. 5, as is shown for stanchion 196*b*, stanchions 196 each are formed as having a smaller diameter, proximal lower portion, 200, and a larger diameter, distal upper portion, 201. The lower proximal portion 200 of each stanchion 196 is threadably or otherwise received within a corresponding aperture, shown at 202 in FIG. 6, formed within a crosspiece member, 203. Crosspiece 203 is retained for slidable movement along a rail, 204, mounted under the lower surface 166 of floor 162. To receive the mounting of stanchions 196 within crosspiece 203, floor 162 is further configured, as may be seen best in FIG. 6, as having a plurality of spaced-apart rebates, one of which is designated at 206, each extending rearwardly from floor forward end 168 generally parallel to feed axis 160. As crosspiece 203 extends transversely, i.e. perpendicularly to feed axis 160, across rebates 206 intermediate the left and right sides 172 and 174 of floor 162, it will be appreciated that the number of stanchions 196 attached to crosspiece 203 may be increased or decreased to span substantially the entire widthwise extent 74 (FIG. 3) of the data plates 54 in stack 55 for effecting a uniform force distribution thereon.

For sequentially advancing each of plates 54 in stack 55 to the forward end 154 thereof, crosspiece 203 is provided to be movable in the direction of frame forward wall 176. Effecting this movement is a tensioning assemblage, referenced generally in FIG. 8 at 208, which is operably coupled to crosspiece 203 for applying a forwardly-directed biasing force, represented by arrow 210 in FIGS. 5 and 6, thereto. As may be seen in FIGS. 5 and 8, tensioning assemblage 208 may include one or more elongate springs, known as constant force springs, a spaced-apart pair of which are shown at 212*a–b*. Springs 212, preferably formed as thin, metal ribbons, each are provided to extend from a rearward end, 214*a–b*, attached to crosspiece 203, to a forward end, 216*a–b*, coupled to a spring-loaded, generally cylindrical take-up reel, 218, disposed under base 82. Reel 218 is rotatable to wind springs 212 around the outer diameter thereof effecting the siding movement of crosspiece 203 and attached stanchions 196 in the direction of forward wall 84. A lever, shown at 220 in FIG. 8, may be coupled to crosspiece 203 for its rearward retraction unwinding springs 212 from around reel 218.

Returning to FIG. 5, feed assembly 157 may be seen to additionally include a lift member, shown generally at 230, actuable to upwardly displace the data plate 54 which has been previously advanced to the forward end 154 of stack 55 into grippable adjacency with gripper 52 for extraction from the stack when the gripper is disposed in its first position. Lift member 230 includes a cylinder, 232, which may be pneumatically-actuated and which is operably coupled to a lifter bit, 233. As may be seen best in FIG. 8, lifter bit 233, as mounted on a support, 234, with associated fasteners, 235, is configured as having one or more projections, one of which is referenced at 236, each extending rearwardly through the forward surface, 238, of frame forward wall 176. That is, and as may be seen through momentary reference to FIG. 7, forward wall 176 is formed as having a plurality of spaced-apart, elongate openings, one of which is shown at 240, formed therethrough. Each of openings 240 extends generally perpendicular to feed axis 160 and is aligned in registration with a corresponding one of rebates 206 of floor 170. Accordingly, and as may be seen in FIGS. 5 and 8, each of projections 236 extends partially into a corresponding floor rebate 206 to be movable therethrough responsive to the actuation of cylinder 232. In this regard, cylinder 232 is actuable to move the projections 236 through the corresponding floor rebates 206 from a lower position wherein the projections are disposed under at least a portion of the lower edge 72 of the plate 54 disposed at the forward end 154 of stack 55, to an upper position, shown in FIG. 5. In such upper position, the lower edge 72 of the forward end plate 54 is supported on at least one of the projections 236 for the displacement of the upper edge 70 of that plate a predetermined vertical distance above stack 55. As displaced, the forward end plate 54 is thereby moved into grippable adjacency with gripper 52 for extraction from the stack. Following the extraction of the forward end plate 54, the next succeeding plate is advance to the forward end 154 of the stack by tensioning assemblage 208 as lifter bit 233 is returned to its first position.

As was aforementioned, floor 162 preferably is provided to be movable vertically relative to second coordinate axis 124 (FIG. 1) in order to accommodate for differing lengthwise extents 68 (FIG. 3) of the workpieces. Further in this regard, and as may be seen in FIG. 5, cylinder 232 likewise may be movably positionable vertically relative to axis 124 for the location of the lifter bit projections 236 under plate edges 72 when lifter bit 233 is moved to its lower position. Accordingly, cylinder 232 is provided as having an elongate extension, 242, which is received through an upper mount, 244, attached to the rearward surface 86 of backplate 84. A bearing, 245 is slidably received on a associated rail, 246, as attached to backplate rearward surface 86 and bit support 234 for further supporting cylinder 232. As movable along rail 246 and with extension 242 being releasably secured within mount 244 via a locking lever assembly, 247, cylinder 232 thereby may be adjustably positioned at select vertical orientations determining, in conjunction with the vertical positioning of floor 162, the extent of the displacement of the upper edge 70 of the forward end plate above stack 55. Lifter bit 233 extends a nominal 0.015 in to engage and elevate plate 54 and should not normally need to be adjusted. However, the rearward extent of lifter bit projections 236 likewise may be adjusted by loosening fasteners 235 and moving lifter bit 233 forwardly or rearwardly relative to feed axis 160.

Continuing with FIG. 5, and looking additionally to FIGS. 2 and 6, a gate member, 250, optionally may be provided as disposed generally perpendicular to feed axis 160 to extend across stack 55 a spaced-apart distance above floor 162. As slidably adjustably mounted to magazine side walls 180 and 182, gate member is lockably positionable thereon with a pair of associated adjustment knobs, 252*a–b*, at a predetermined distance from rearward surface 195 of magazine forward wall 176 defining a gap, designated at 254, therebetween. Advantageously, and as is shown in FIG. 5, gap 254 may be sized as corresponding to the thickness of a single plate 54 admitting only the plate 54 at the forward end 154 of stack 55 therethrough as lifter bit projections 236 are moved from their lower to their upper position displacing that plate from the stack. In this way, the next succeeding plate is maintained in stack 55 for its sequential presentation by lift member 230 to gripper 52.

Considering next the programmed choreography of printer 12 as illustrated in the figures and as may be operated under the logic control of a resident program loaded in controller 40, the printing cycle commences with the printer placed on-line as energized, pressurized, and loaded with a data plate stack 55. Initially, carriage 128 is reset under the control of steppers 130 and 132 along axes 122 and 124 to a home position, corresponding generally to the position shown in FIG. 2, located vertically, with gripper jaws 114*a* and 114*b* located in left-justified fashion above stack 55. Such position may be signaled, for example, by a proximity switch or mechanical limit which may be adjustable to position gripper jaws 114*a* and 114*b* is such left-justified position. Alternately, the gripper jaws may be located centrally with respect to the widthwise extents of the data plates via software programming or by lateral adjustment of said proximity switch or mechanical limit. From the home position, gripper 52 is translated vertically downward along axis 124 to its first or pickup position, shown in FIG. 5, for the extraction of the data plate 54 located at the forward end 154 of stack 55 from the stack. In such position, gripper jaws 114*a* and 1 14*b* are disposed in an opened orientation.

Continuing with the cycle, lift cylinder 232 next is actuated to move liter bit 233, and the projections 236 thereof, vertically upward through the corresponding floor rebates 206 from its lower position to the upper position effecting, as is shown in FIG. 5, the displacement of the upper edge 70 of the forward end stack plate into grippable adjacency with gripper jaws 114. The plate thereby is presented co-planarly to gripper 52 as aligned within the plane defined by the intersection of coordinate axes 122 and 124. Thereupon, the gripper may be closed to grip the displaced plate, and then moved vertically upward along axis 124 to extract the plate from stack 55. As the plate is extracted, cylinder 232 again is actuated to return lifter bit 233 to its lower orientation, with the next succeeding plate in stack 55 being advanced to the forward end 154 thereof by the forward movement of crosspiece 203 and stanchions 196*a* and 196*b* responsive to the forwardly-directed biasing force 210 developed by tensioning assemblage 208.

With the plate being retained between its jaws 114, gripper 52 may be translated on carriage 128 along axis 122 to the second gripper or marking position shown in FIG. 4. In such position, plate 54 is interposed between marking pin impacting tip 104 and anvil impacting surface 92, with the second surface 64 of the plate being supported in bearing adjacency with impacting surface 92. With surface 92 being configured as having a generally circular geometry and a diameter of about 0.188 in (6 mm) or less, a correspondingly sized reaction portion of the plate is supported for the impact marking thereof. In supporting only this reaction area of the plate, the marking window or locus thereof, as defined by outer margin 66 less the gripped edge 70, is maximized in providing generally unobstructed access thereto by gripper 52. Within this marking locus, plate 54 may be moved with gripper 52 along axes 122 and 124 for disposition at one or more coordinate-defined pixel locations. At each location, intermediate the incremental x-y stepper movements, pin impacting tip 104 is pneumatically reciprocated along marking axis 106 from its retracted position shown in FIG. 4, to its extended position in an indentation-defining contact with the first surface 62 of the plate.

Thereafter, the plate again may be moved with the gripper along axes 122 and 124 to a predetermined drop-off location, typical at the left travel limit opposite the home position, wherein the gripper jaws are opened to release the plate. Although not shown in the accompanying drawings, the now marked data plate 54 may be deposited into a bin or stacked into a carrier in an order corresponding to the order in which the plates were marked. Completing the cycle, the gripper may be returned along axes 122 and 124 to its home position or right travel limit, whereat the repetition of the cycle may commence. As noted, control over the printer 12 from a logic and electronic standpoint may be carried out by a separately-located controller, such as controller 40, typically involving a central processing unit (CPU) logic section, an input/output (I/O) section, a power supply section, and a motor interface and driver section along with a driver function. The general programming of such controller is described, for example, in detail in commonly-assigned U.S. Pat. Nos. 5,316,397 and 5,368,400.

Unless otherwise specified hereinbefore, materials of construction suitable for the fabrication of printer 12 are to be considered conventional for the uses involved. Where possible, plastic materials are preferred for weight considerations and for ease of manufacturing.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed is:

1. An apparatus for marking a generally planar object at a first surface thereof with one or more indentation-defined pixels, the object having a second surface opposing the first surface and an outer margin which extends along a lengthwise dimension between an upper and a lower end edge, and along a widthwise dimension between a first side edge and a second side edge, the object being presented to said apparatus in a generally upstanding relationship as aligned co-planarly with a coordinate plane defined by the intersection of a first coordinate axis and an orthogonal second coordinate axis, said apparatus comprising:

an anvil member having an impact surface fixably mounted at a predetermined position within said coordinate plane, said impact surface being configured for supporting at least a portion of the second surface of said object when the object is moved into a bearing, force transferring adjacency therewith;

a marking head positionable in a fixed relationship with respect to said anvil member, said head including a confronting portion opposing said impact surface of said anvil member at a space-apart distance therefrom, and a marker pin having a distal impacting tip issuable from said confronting surface, said tip being reciprocatably movable along a marking axis disposed generally perpendicular to said plane from a retracted position spaced-apart from said plane to an extended position within said plane defining a stroke length of said pin; and a gripper being actuable in a first position to grip the object along an edge thereof, and being movable with the object along said first and said second coordinate axis to a second position disposing the object intermediate said marking head assembly and said anvil member in bearing adjacency therewith, said gripper being further movable with the object in said second position along said first and said second coordinate axis to define a marking locus between the edges of the object wherein the first surface of the object is disposed at one or more predefined pixel locations for indentation contact with said impact tip when said tip is moved to said extended position.

2. The apparatus of claim 1 wherein said gripper is further movable along the coordinate axes to a third position, said gripper being actuable in said third position to release the object.

3. The apparatus of claim 1 wherein said gripper is actuable in said first position to grip the object along the upper edge thereof.

4. The apparatus of claim 1 wherein said gripper includes a pair of jaws actuable between a closed orientation and an opened orientation for respectively gripping and releasing the object.

5. The apparatus of claim 1 wherein said impact surface of said anvil member supports only the portion of the second surface of the object opposing the first surface which reacts to the indentation contact of the first surface by said impact tip.

6. The apparatus of claim 1 further comprising a drive assembly for effecting the movement of said gripper, said drive assembly including:

a first motor means operably coupled with said gripper for linearly moving said gripper along said first coordinate axis in given first translational increments; and a second motor means operably coupled with said gripper for linearly moving said gripper along said second coordinate axis in given second translational increments;

whereby said impact tip of said pin is movable to said extended position for indentation contact with the first surface of the object between the first and second translational incremental movements of said gripper.

7. The apparatus of claim 1 further comprising a frame including a stationary first upright member and a second upright member movably spaced-apart therefrom, said anvil member being mounted to said first upright member and said marking head being mounted to said second upright member to be positionable at a variably fixed relationship to said anvil member for determining the stroke length of said pin.

8. The apparatus of claim 7 further comprising a drive assembly for effecting the movement of said gripper, said drive assembly including:

a first rail member mounted on said first upright member along said first coordinate axis;

a carriage member slidably movably mounted on said first rail member;

a second rail member mounted on said carriage along said second coordinate axis, said gripper being slidably movably mounted on said second rail member;

a first motor mounted on said first upright member and operably coupled with said carriage for linearly moving said carriage along said first coordinate axis; and a second motor mounted on said carriage and operably coupled with said gripper for linearly moving said gripper along said second coordinate axis.

9. The apparatus of claim 1 further comprising a feed assembly adapted to present each of the objects in said generally upstanding relationship to said gripper when said gripper is in said first position, said feed assembly including:

a magazine configured for receiving one or more of said objects in a stack disposed along a feed axis extending generally perpendicular to said coordinate plane, said stack having a forward end disposable in grippable adjacency with said gripper and a rearward end;

a feeder for sequentially advancing a succeeding one of the objects in said stack to said forward end thereof as an immediately preceding one is displaced therefrom; and a lift member actuable to displace the object at the forward end of the stack into grippable adjacency with said gripper when said gripper is disposed in said first position.

10. The apparatus of claim 9 wherein said magazine includes a floor which extends from a rearward end to a forward end, and a generally upstanding forward wall disposed at the forward end of said floor, said floor being configured as having a upper surface for supporting the lower edges of the objects and a lower surface, and as having a plurality of spaced-apart, elongate rebates formed through the forward end thereof, each of said rebates extending rearwardly from the forward end of said floor generally parallel to said feed axis, and wherein said feeder comprises:

a crosspiece slidably movably retained under the lower surface of said floor as extending transversely substantially across said rebates, said crosspiece being positionable at a spaced-apart distance from said forward wall accommodating the receiving of said stack therebetween, and being movable toward said end wall responsive to a forwardly-directed biasing force for sequentially advancing the objects in said stack to the forward end thereof, one or more uprights each mounted to said crosspiece through a corresponding one of said rebates retaining said crosspiece under the lower surface of said floor, said uprights being positionable with said crosspiece at a spaced-apart distance from said forward wall accommodating the receiving of said stack therebetween, and being movable with said crosspiece toward said forward wall for sequentially advancing each of the objects in said stack to the forward end thereof, and a tensioning member operably coupled to said crosspiece for applying a forwardly directed biasing force thereto effecting the movement of said crosspiece and said upright toward said forward wall.

11. The apparatus of claim 10 wherein said uprights are mounted to said crosspiece to span substantially the entire widthwise extent of the object.

12. The apparatus of claim 10 wherein said tensioning member comprises:

one or more elongate springs each extending from a rearward end attached to said crosspiece to a forward end; and a take-up reel coupled to the forward end of each of said springs, said reel being rotatable to wind said springs therearound effecting the movement of said crosspiece and said upright toward said forward wall.

13. The apparatus of claim 9 wherein said magazine comprises a floor which extends from a rearward end to a forward end, and a generally upstanding forward wall disposed at the forward end of said floor, said floor being configured as having an upper surface for supporting the lower edges of the objects and a lower surface, and as having a plurality of spaced-apart, elongate rebates formed through the forward end thereof, each of said rebates extending from the forward end of said floor generally parallel to said feed axis, said forward wall being configured as having a rearward surface for supporting the second surface of the object disposed at the forward end of the stack and a forward surface, and as having a plurality of spaced-apart, elongate openings formed therethrough, each of said openings extending generally perpendicular to said feed axis as aligned with a corresponding one of said rebates in said floor, and wherein said lift member comprises:

a lifter disposed adjacent the forward surface of said forward wall, said lifter having one or more projections each extending rearwardly therefrom through a corresponding one of said slots of said forward wall, and each being movable through a corresponding one of said rebates of said floor; and a cylinder operably coupled to said lifter, said cylinder being actuable to move the projections of said lifter through the rebates of said floor from a lower position wherein said projections are disposed under at least a portion of the lower edge of the object at the forward end of said stack, to an upper position whereby the lower edge of the object at the forward end of the stack is supported on at least one of said projections and is moved therewith for displacement of that object from said stack into said grippable adjacency with said gripper.

14. The apparatus of claim 13 wherein said feed assembly further comprises a gate member adjustably mounted to said magazine at a spaced-apart distance above the upper surface of said floor as extending across said stack generally perpendicular to said feed axis, said gate member being positionable a predetermined distance from the rearward surface of said forward wall to define a gap therebetween, said gap being sized to admit only the object at the forward end of said stack therethrough as said lifter projections are moved from said lower to said upper position displacing that object from said stack.

15. The apparatus of claim 13 wherein said floor and said cylinder are each movable relative to said second coordinate axis for positioning the upper edge of the object displaced from the forward end of said stack at a predetermined distance from said gripper when said gripper is disposed in said first position.

16. The apparatus of claim 13 wherein said magazine further comprises at least one upstanding side wall having an inward surface for supporting one of the side edges of the objects, and wherein said feed assembly further comprises a fence member adjustably mounted to said magazine as extending along said floor generally parallel to said feed axis, said fence member being positionable a spaced-apart distance from the inward surface of said side wall to justify said stack therebetween.

17. A method for marking a generally planar object at a first surface thereof with one or more indentation-defined pixels, the object having a second surface opposing the first surface and an outer margin which extends along a lengthwise dimension between an upper and a lower end edge, and along a widthwise dimension between a first side edge and a second side edge, said method comprising the steps of:

(a) providing an anvil having an impact surface fixably mounted at a predetermined position within a coordinate plane defined by the intersection of a first coordinate axis and an orthogonal second coordinate axis;

(b) positioning a marking head at a fixed relationship with respect to said anvil, said head including a confronting portion opposing said impact surface of said anvil at a space-apart distance therefrom, and a marker pin having a distal impacting tip issuing from said confronting portion as reciprocatably actuable along a marking axis disposed generally perpendicular to said plane from a retracted position spaced-apart from said plane to an extended position within said plane, (c) disposing the object intermediate said marking head and said anvil, at least a portion of the second surface of the object being supported on the impact surface of the anvil;

(d) moving the object along the first and second coordinate axes to a predefined pixel location within a marking locus defined by the outer margin of the object; and (e) reciprocatingly actuating the impacting tip of the marker pin from its retracted position to its extended position to impact the first surface of the object in an indentation contact defining one of said pixels.

18. The method of claim 17 further comprising the additional step after step (e) of:

(f) returning to step (d) of the method to generate a sequence of said pixels defining a one or more pixel matrix characters.

19. The method of claim 18 wherein the object is moved is step (d) along the first and second coordinate axes in a series of discrete translational increments, and wherein the impacting tip of the marker pin is actuated in step (e) between a successive pair of said increments.

20. The method of claim 17 further comprising the additional step intermediate steps (b) and (c) of providing the object at a first location a spaced-apart distance from the impact surface of the anvil as aligned co-planarly with the coordinate plane, and wherein the object is disposed in step (c) by its movement along the coordinate axes.

* * * * *